US006532888B1

(12) United States Patent
Enik

(10) Patent No.: US 6,532,888 B1
(45) Date of Patent: Mar. 18, 2003

(54) FUEL SPILLAGE CONTAINMENT DEVICE AND METHODS RELATED THERETO

(76) Inventor: Mark J. Enik, 5 Miacomet Ave. P.O. Box 661, Nantucket, MA (US) 02554

( * ) Notice: Subject to any disclaimer, the term of this patent is extended or adjusted under 35 U.S.C. 154(b) by 0 days.

(21) Appl. No.: 09/975,868

(22) Filed: Oct. 12, 2001

(51) Int. Cl.[7] ..... B63B 17/00
(52) U.S. Cl. ..... 114/343; 141/86; 141/392
(58) Field of Search ..... 141/86, 311 A; 114/343, 364, 211; 220/560.03, 573, 4.14, 476, 364, 745, 913

(56) References Cited

U.S. PATENT DOCUMENTS 5,027,965 A * 7/1991 Dumars ..... 114/211
5,070,806 A * 12/1991 Coster ..... 114/343
5,645,004 A * 7/1997 Holland ..... 114/211
5,692,547 A * 12/1997 Lehr ..... 114/364
5,765,604 A * 6/1998 Garvey, III ..... 114/211
5,850,858 A * 12/1998 Zeigler ..... 114/343
5,989,608 A * 11/1999 Mizuno ..... 219/735

* cited by examiner

*Primary Examiner*—Stephen Avila
(74) *Attorney, Agent, or Firm*—David G. Conlin; William J. Daley, Jr.; Edwards & Angell, LLP

(57) ABSTRACT

Featured is a fuel spill containment device that collects fuel being spilled from the vent of a fuel tank. The fuel spill containment device includes a first member having a through aperture, a flexible container being attached to the first member so an interior volume of the container is in fluid communication with the through aperture and an adhesive layer. The first member through aperture also is configured and arranged so as to be larger than a structure of the vent as it passes through a surface of a tank support structure. The adhesive layer is applied to a portion of a surface of the first member at an angle to an axis of the through aperture. This portion is set so the first member is removably secured to the tank support structure surface. Also featured is a fuel spill containment device for use in containing spills s from the vent of a motorized water vessel and methods related thereto.

17 Claims, 4 Drawing Sheets

FUEL SPILLAGE CONTAINMENT DEVICE AND METHODS RELATED THERETO

FIELD OF INVENTION

The present invention relates to device for containing fuel spillages including methods related thereto and more particularly to such containment devices for use in marine applications.

BACKGROUND OF THE INVENTION

A motorized boat or vessel typically employs an internal fuel tank to store the fuel for the engine(s) that power the boat. Such a tank is filled through a filler neck that is connected to the tank by appropriate plumbing. Safety regulations require the fuel tank to be vented outside the boat's hull to prevent the build-up of fuel vapors within the hull. Typically, the vent includes a fitting or tubular member a portion of which extends through a hole in the boat's hull provided for this purpose.

In addition to allowing vapors to escape, the vent also provides a discharge pathway for the fuel, such as gasoline. When a fuel tank is overfilled during refueling there can be an inadvertent discharge of the fuel through the discharge line. In addition, boat owners may, although improper, fill the fuel tank until fuel is observed coming out of the vent line as a means for determining when the fuel tank is full. Such discharges can result in small amounts of fuel or gasoline to spill into the body of water surrounding the boat being refueled. Such discharges are problematic because of safety or fire hazards concerns and water pollution concerns.

A number of devices have been developed in an attempt to prevent the spillage of gasoline during refueling to the environment. One group of such devices locate a mechanism proximal the vent fitting to collect any fuel coming out of the fitting, and to route it to a bulk storage container in which the fuel is collected in bulk. Because of attachment considerations, some bulk storage containers have been proven difficult to use when trying to pour the fuel from the container into more permanent storage. In addition some of the bulk storage containers are open to atmosphere, thus allowing vaporizing fuel to escape causing air pollution. Some exemplary devices are found in U.S. Pat. Nos. 5,070,806; 5,850,858; and 5,469,800.

Another group of devices for preventing spillage to the environment comprises an open-ended container that is located proximal the air vent. The fuel exiting the air vent empties into the open end of the container so it can be collected therein. It is not uncommon, however, that some of fuel will escape to the environment despite the presence of the collection device thereby polluting the water. The open end also allows any fuel being collected that vaporizes to escape to the atmosphere thereby causing air pollution. In addition, it is quite possible for the collected fuel to escape out the open end, when the device is being removed from the hull. Some exemplary devices are found in U.S. Pat. Nos. 5,715,876; 5,230,372; 4,802,514 and 4,082,125.

Yet another group of devices for preventing spillage to the environment, attempt to establish a tight seal between the container and the air vent through hull fitting and in some cases also forming a mechanical interconnection between the through hull fitting and the container. One of these devices utilizes suction cups to maintain a secure attachment to the boat hull. These devices are not easily adaptable for use with a wide range of fitting designs or sizes. The securing mechanism also increases the risk of spillage when removing the device from the boat. Some exemplary devices are found in U.S. Pat. Nos. 5,738,154; 5,762,114 and 5,765,604.

It thus would be desirable to provide a new device for containing inadvertent fuel spillages so they do not escape to the environment (e.g., water, atmosphere) and methods related thereto. It would be particularly desirable to provide such a device that is adaptable for use with a wide range of types and sizes of vent pipes or fittings and which can be removably attached to a boat hull. Such a device also would reduce the risk of accidental spillage while detaching the device in comparison to prior art devices. It also would be desirable to provide such a device that does not require as much storage space (i.e., less bulky) as compared to prior art devices. Such collection devices preferably would be simple in construction and less costly than prior art devices and such methods would not require highly skilled users to utilize the device.

SUMMARY OF THE INVENTION

The present invention features a device for containing, including collecting, a spill of fuel such as gasoline from the vent of a fuel tank. Such a device is of particularly utility for containing and collecting the fuel spilled from the vent of a fuel tank of a motorized water vessel (e.g., boat), which vent typically exits through the hull of the vessel.

According to one embodiment of the present invention, the fuel spill containment device is configured and arranged to contain as well as collect fuel being spilled from a vent of a fuel tank. Such a fuel spill containment device includes a first member having a through aperture, a flexible container being attached to the first member so an interior volume of the container is in fluid communication with the through aperture and an adhesive layer. The first member through aperture is configured and arranged so as to be larger than a structure of the vent as it passes through a surface of a tank support structure. The adhesive layer is applied to a portion of a surface of the first member at an angle to an axis of the through aperture. This portion is set so the first member is removably adhesively secured to the tank support structure surface.

In an exemplary embodiment, the portion on which the adhesive layer is applied comprises about 50% of the first member surface. In other exemplary embodiments, the adhesive layer is applied to the first member surface so that it extends one of about approximately ½ of the circumference of the first member or about approximately ¾ of the circumference of the first member.

In specific embodiments, the first member also is configured and arranged so a region thereof in which the adhesive layer is not applied is configured and arranged so as to form a depression in the first member. In a more particular embodiment, the depression is formed in the first member so as to create a funnel, nozzle or spout in a local region of the first member. In use, such a depression is used in one case to form a vent path to allow air or gases within the flexible container to escape or vent as fuel is being collected within the flexible container. The depression also provides a mechanism by which the user can controllably pour the collected fuel from the flexible container into another storage container for use or disposal, after the spill containment device is detached from the tank support structure surface.

Alternatively, the depression is formed from one or more creases, score lines or surface artifacts provided in a local region of the first member. In addition to providing a vent path, a user can manually manipulate the so formed depressed region so as to more fully develop a spout or equivalent so the collected fuel can be poured from the flexible container.

The first member also is further configured and arranged so as to include a tab portion that extends outwardly from a main portion of the first member, the main portion including the through aperture, where the tab portion includes a through aperture. In more particular embodiments, the adhesive layer is not applied to the first member main portion in the area of the tab portion. The tab portion provides a mechanism by which a user can detach the spill containment device from the tank support structure surface.

According to another embodiment of the present invention, the fuel spill containment device is more particularly configured and arranged to contain as well as collect fuel, such as gasoline that can be spilled from a vent of a fuel tank of a motorized water vessel (e.g., boat). The fuel spill containment device includes a first member having a through aperture, a flexible container that is attached to the first member so that an interior volume of the flexible container is in fluid communication with the first member through aperture and an adhesive layer. The first member through aperture is configured and arranged so as to be larger than a structure of the vent as it passes through a hull surface of the motorized water vessel. The adhesive layer is applied to a portion of a surface of the first member that is at an angle to an axis of the through aperture, where the portion being set so the first member is removably secured to the hull surface.

In an exemplary embodiment, the portion on which the adhesive layer is applied comprises about 50% of the first member surface. In other exemplary embodiments, the adhesive layer is applied to the first member surface so that it extends one of about approximately ½ of the circumference of the first member or about approximately ¾ of the circumference of the first member.

In specific embodiments, the first member also is configured and arranged so a region thereof in which the adhesive layer is not applied is configured and arranged so as to form a depression in the first member. In a more particular embodiment, the depression is formed in the first member so as to create a funnel, nozzle or spout in a local region of the first member. In use, such a depression is used in one case to form a vent path to allow air or gases within the flexible container to escape or vent as fuel is being collected within the flexible container. The depression also provides a mechanism by which the user can controllably pour the collected fuel from the flexible container into another storage container for use or disposal, after the spill containment device is detached from the hull surface. Alternatively, and under appropriate circumstances, the collected fuel is poured into the fuel tank the vent is connected to or into another fuel tank.

Alternatively, the depression is formed from one or more creases, score lines or surface artifacts provided in a local region of the first member. In addition to providing a vent path, a user can manually manipulate the so formed depressed region so as to more fully develop a spout or equivalent so the collected fuel can be poured from the flexible container into another storage container for use or disposal.

The first member also is further configured and arranged so as to include a tab portion that extends outwardly from a main portion of the first member, the main portion including the through aperture, where the tab portion includes a through aperture. In more particular embodiments, the adhesive layer is not applied to the first member main portion in the area of the tab portion. The tab portion provides a mechanism by which a user can detach the spill containment device from the tank support structure surface.

Also featured is a method for containing fuel spilling from a vent of the fuel tank of a motorized water vessel, which containing also includes collecting any such fuel spillage. The method includes providing a spill containment device including a first member having a through aperture and a flexible container being attached to the first member so that an interior volume of the flexible container is in fluid communication with the first member through aperture. The first member through aperture also is configured and arranged so as to be larger than a structure of the vent as it passes through a hull surface of the motorized water vessel. The method also includes positioning the first member so that the vent structure is disposed within the first member through aperture, whereby the vent structure is in fluid communication with an interior volume of the flexible container and releasably, adhesively securing a portion of the first member to the hull surface in proximity to the vent structure.

In specific embodiments, said releasable, adhesively securing includes releasable, adhesively securing a portion of the first member one of about ½ of the circumference of the first member or about ¾ of the circumference of the first member. Further, at least a part of the portion being adhesively secured is located below the vent structure.

The first member is configurable so as to include a region therein, in which the adhesive layer is not applied, that is configured and arranged so as to form a depression in the first member. Reference shall be made to the foregoing discussion for the spill containment devices as to the formation and creation of such a depression or depressed region. When the first member is so configured, the method further includes the step of venting the interior volume via the depression while collecting fuel within the interior volume. In this way, pressure is not built up within the interior volume as fuel is being collected.

The method according to the present invention further includes the step of detaching the first member from the hull surface. In an exemplary embodiment, said positioning and said releasably adhesively securing is accomplished before refueling of the fuel tank and said detaching is accomplished after the refueling.

The first member is configurable so as to include a tab portion having a through aperture extending from a main potion of the first member, the main portion including the first member through aperture. In such a case, said detaching further comprises inserting an end portion of a boat hook into the tab portion through aperture; and manipulating the boat hook so as to detach the first member from the hull surface.

Following detachment, the method of the present invention also includes disposing of the collected fuel and disposing of the spent or used spill containment device. The collected fuel is disposed using any of a number of methods or techniques known to those skilled in the art that otherwise comply with applicable rules and regulations. For example, the collected fuel can be poured into a fuel tank for re-use or into a storage tank or other device or apparatus provided for the proper disposal of the collected fuel. Similarly, the spent spill containment device is disposed of using any of a number of methods or techniques known to those skilled in the art that otherwise comply with applicable rules and regulations. It is within the scope of the present invention, however, for a spill containment device to be re-used to collect fuel from in a subsequent application, dependent upon the condition of the device following the prior usage. For example, the prior use may not have involved any spillage.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 1:
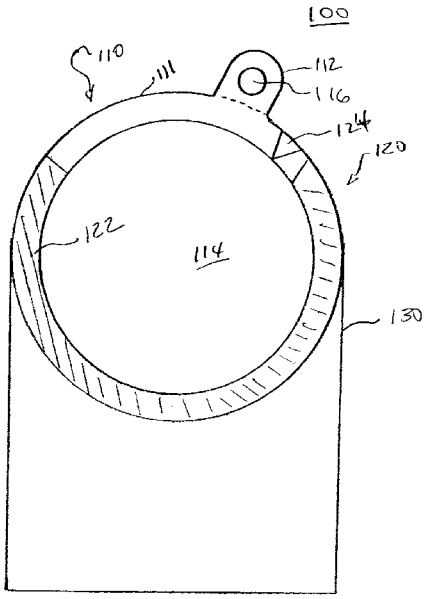
FIG. 1 is a front view of an exemplary spill containment device according to the present invention when fully expanded.
Figure 2:
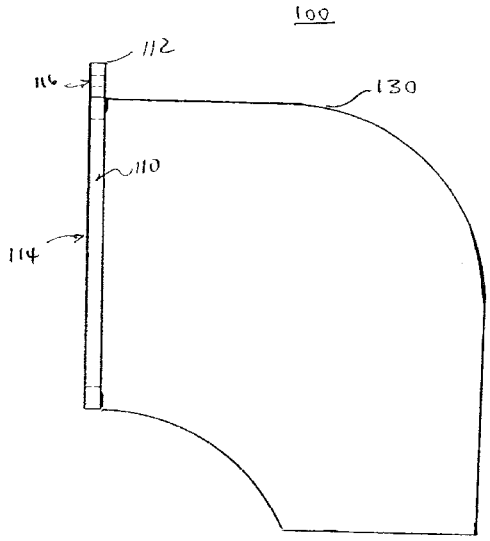
FIG. 2 is side view of the spill containment device of FIG. 1.
Figure 3:
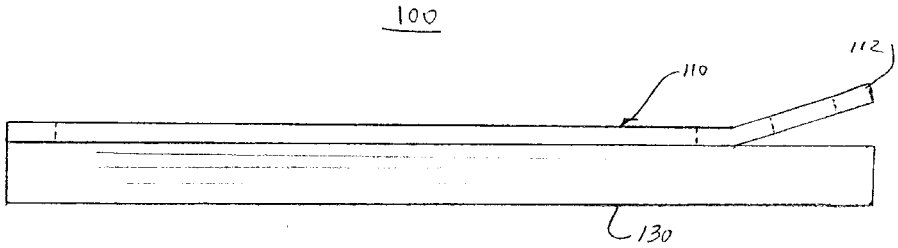
FIG. 3 is a side view of the spill containment device of FIG. 1 when arranged for storage.

Referring now to the various figures of the drawing wherein like reference characters refer to like parts, there is shown in FIGS. 1–3 various views of a fuel spill containment device 100 according to the present invention, which device includes a plate member 110 having a tab portion 112 and a foldable container or bag 130. FIGS. 1–2 are illustrative of the condition where the foldable bag 130 is in an unfolded or expanded state such as would be during fuel collection and FIG. 3 is illustrative of the fuel spill containment device 100 when configured for storage.

The plate member 110 includes an aperture 114 therein, and in the illustrated embodiment, the plate member 110, exclusive of the tab portion 112, is generally configured as a ring shaped member. The plate member 110, however, shall not be particularly limited to this geometric shape as it is within the scope of the present invention for the plate member to be configured with any two-dimensional geometric shape otherwise consistent with the teachings of the present invention, including polygonal shapes for example a hexagon.

Figure 5:
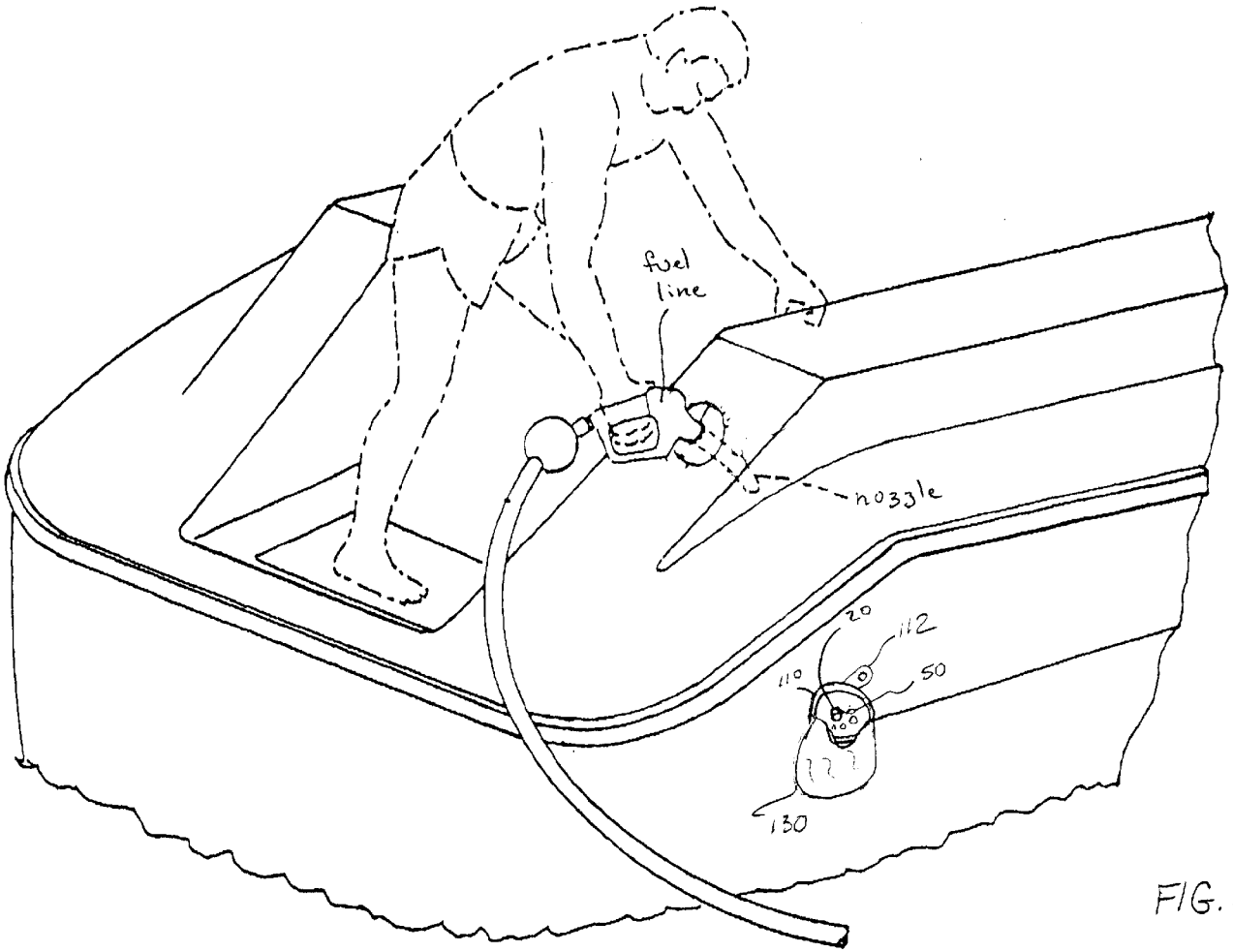
FIG. 5 is a perspective view illustrating a re-fueling operation when using a spill containment device of the present invention.

The plate member 110 is generally sized so as to be adaptable to receive within the aperture 114 any of a number of marine fuel tank through hull vent fittings or fixtures as is known to those skilled in the art. More particularly, the diameter of the plate member aperture 114 is set so that it provide an opening sufficiently sized so that any of a number of these vent fittings or fixtures can be received in the opening, more specifically received therein without the need for special handling or manipulation when mounting the spill containment device 100 to a boat hull 10 (FIG. 5). In an illustrative embodiment, the plate member aperture 114 has a diameter of about 7 inches.

The plate member 110 is made of any of a number of materials that are appropriate for the intended use and environment of such use. In further embodiments, the material in combination with the physical dimensions of the plate member (e.g., thickness) yields a member that has sufficient flexibility to generally conform to the portion of the boat hull 10 to which the plate member is to be secured. In an illustrative embodiment, the plate member 110 is made of a molded plastic or rubber. In an illustrative, exemplary embodiment the ring-shaped plate member has a thickness in the range of from about 1/32 of an inch to 1/8 of an inch and more particularly in the range of from about 1/32 of an inch to 1/16 of an inch.

The plate member 110 also is configured and arranged so as to provide a front surface 118 having a sufficient surface area for removably attaching and securing the plate member to the boat hull 10 (FIG. 5). Stated another way, the outer diameter of the generally ring shaped plate member is set so as to provide such an area. In an illustrative embodiment, the outer diameter is set so the width of the ring is about 5/8 inches or more with a plate member aperture 114 having a diameter of 7 inches.

In the illustrated embodiment, the plate member 110 is adhesively, removably attached or secured to the boat hull 10. More particularly, an adhesive material is applied to at least a portion, the adhesive portion 120, of the front surface 118. In a further embodiment, the adhesive material being applied is any one of those known in the art that are used in conjunction with a release paper 122 and for the materials comprising the plate member 110. More particularly, the adhesive materials also shall be those appropriate for a marine use. In an exemplary embodiment, the adhesive is applied so that it covers about 1/2 to 3/4 of the circumference of the ring-shaped plate member. It should be recognized that the present invention is not limited to the illustrative embodiment and that the adhesive can cover more or less of the circumference to obtain the desired adhesive strength and otherwise consistent with the teachings of the present invention.

As is known in the art, the release paper 122 is releasably attached to the adhesive material until the user prior to adhesively securing removes it. In the present invention, the release paper 122 would be removed prior to removably attaching or securing the plate member, more specifically the top surface adhesive portion 120, to the hull 10.

Figure 6:
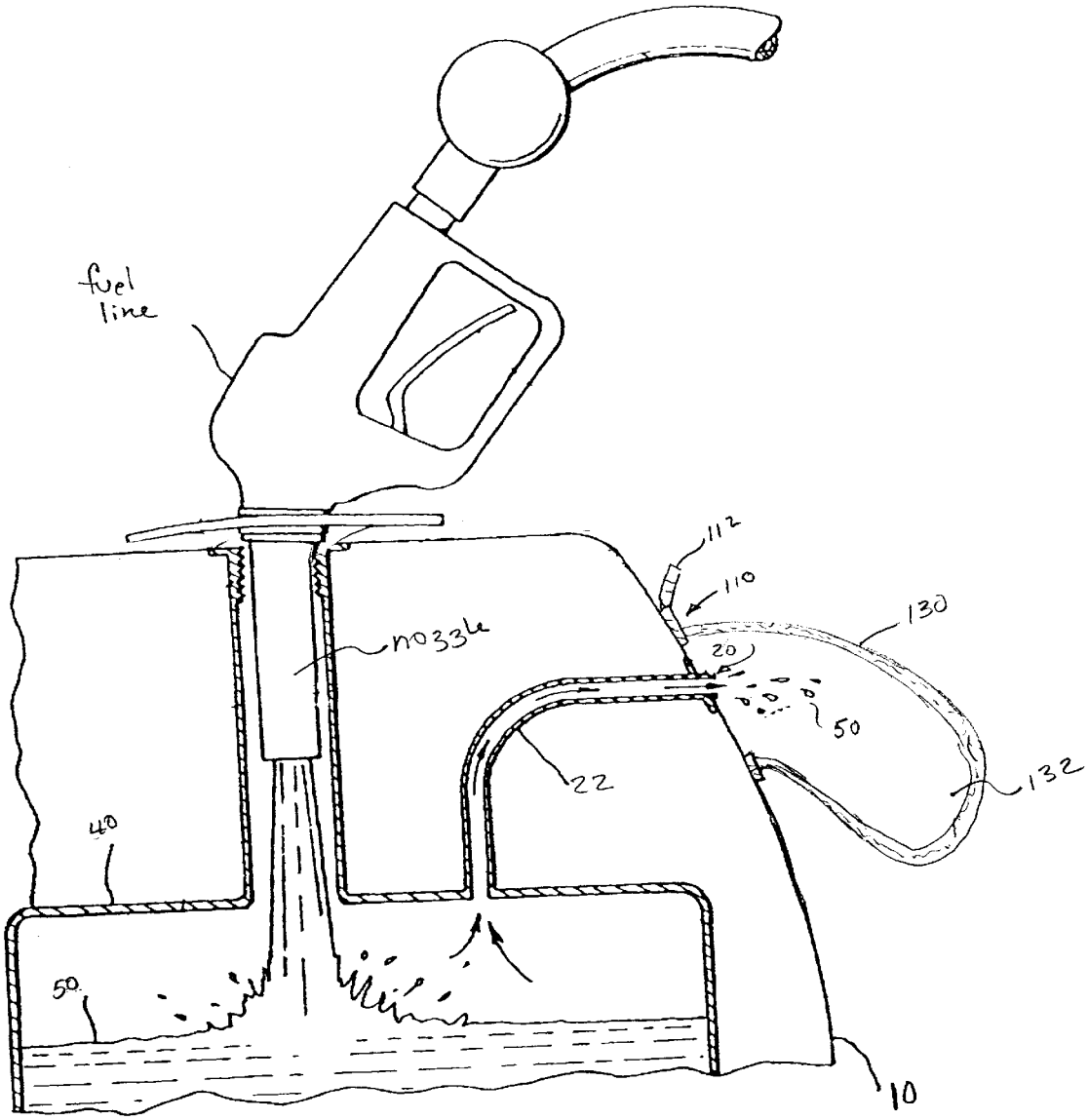
FIG. 6 is a cross-sectional view of the boat and a spill containment device of the present invention further illustrating the use of the device during refueling.

As indicated above, the plate member 110 includes a tab portion 112 that extends outwardly from the main portion 111 of the plate member, in the illustrated embodiment, the ring-shaped portion of the plate member. In a further embodiment, the tab portion 112 is configured and arranged so that it can be bent out of the plane of the main portion 111 of the plate member as illustrated in FIGS. 3 and 6.

The tab portion 112 further includes an aperture 116 therein that is sized and configured such that a conventional boat hook or other similarly configured mechanism or device can be inserted into and received in the aperture. The tab portion also is configured and arranged so as to be capable of withstanding the loads imposed thereon by the boat hook when detaching the spill containment device 100 from the boat hull 10. In an exemplary illustrative embodiment, the tab portion aperture 116 is about 1 5/8 inches in diameter and the distance between the aperture and the outside edge of the tab portion 112 is at least about 1/4 inches or more.

In further embodiments, the plate member 110 is configured and arranged so as to include a depressed region 124.

Such a depressed region 124 is generally formed so as to create a pathway in the plate member 110 from the interior volume 132 (FIG. 6) of the flexible bag 130 to atmosphere. In this way air or gases within the flexible bag 130 after the fuel spill containment device 100 is secured to the boat hull 10 can vent or escape as fuel is being collected within the flexible bag. Such a depressed region 124 also is useable so that collected fuel can be poured out of the flexible bag 130 into another container, storage tank or fuel tank for proper disposal. In the present invention, proper disposal also includes re-introducing the collected fuel into the fuel cycle so that it can be combusted.

According to one embodiment, the plate member 110 is formed or otherwise made so as to include a pre-shaped depression therein comprising the depressed region 124. The so formed depression is in the form of a part of a nozzle, funnel, spout or other geometric shape otherwise providing a structure capable of performing the functions of the depressed region 124 as hereinabove described (e.g., venting, pouring). In an alternative embodiment, the plate member 110 is formed so as to include one or more creases, score lines or other surface artifacts in a localized area of the plate member to thereby form a depressed region 124 that also provides a structure capable of performing the functions of the depressed region as hereinabove described (e.g., venting, pouring). In a further embodiment, the user manually manipulates the area of the plate member 110 including such creases, score lines or other surface artifacts to further form the depressed region 124 so as to create a shaped depression more ideal for controllably pouring of the collected fuel.

The flexible container or bag 130 is opened ended at one end thereof and the end is secured to the plate member 110 using any of a number of techniques or methods known to those skilled in the art so that the interior compartment or interior volume 132 (FIG. 6) comprising the flexible bag is fluidly coupled with the plate member aperture 114. In this way, and as more clearly illustrated in FIGS. 5 and 6, fuel or gasoline exiting the vent fitting 20 will be collected and contained in the flexible bag 130.

The flexible bag 130 has a thickness and is made of any of a number of materials appropriate for containing the fuel therein without degradation, for example for the time period required for re-fueling and proper disposal or handling of the collected fuel and/or the spill containment device 100. Such materials also are preferable appropriate for a marine application. The materials include for example any of a number of plastics such as polyethylene. The thickness of the flexible bag 130 also is more particularly establishes so that it will withstand the expected conditions for handling and normal handling loads. Preferably, the flexible bag 130 also is made from materials that allow the user to observe and determine if any fluid is being collected therein besides any change in shape that might occur as the fluid is collected within the bag.

The flexible bag 130 also is sized and configured such that it is can be easily collapsed to form a compact assemblage as shown in FIG. 3 for storage and which can be expanded to hold possible amounts of fuel or gasoline that might overflow or come-out if the vent fitting/fixture 20 during refueling, for example 6 ounces or less of fuel. In further embodiments, the flexible bag 130 is additionally sized so to reduce the potential for accidental spillage when removing the spill containment device 100 from the boat hull 10. In an exemplary embodiment, the flexible bag 130 is configured so as to have a width or diameter in the range of from about 7 to 10 inches, more particularly about 9¾ inches across and have a length in the range of from about 12 to 19 inches, more particularly 12 inches. A flexible bag 130 in this size range is capable of holding about ½ gallon or more of fluid, which is appreciable more than the amount of fuel one might be expected to overflow. Such a flexible bag 130, as shown in FIG. 3 is capable of being folded upon itself so as to yield a compact package, for example the overall thickness of the package is less than about 1 inch.

Figure 4:
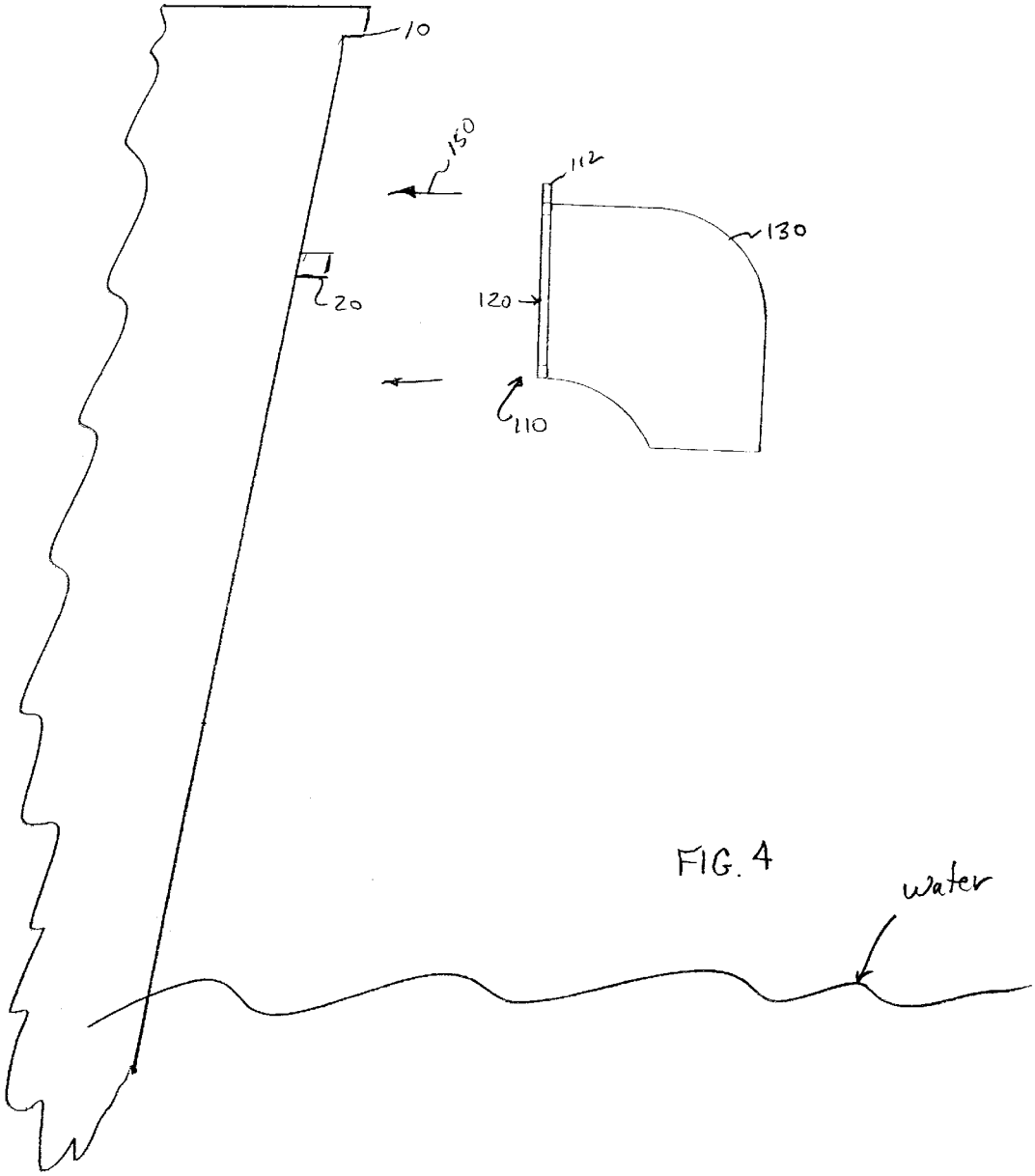
FIG. 4 is a schematic view illustrating use of the spill containment device of FIG. 1.

The use of the fuel spill containment device 100 of the present invention can be best understood from the following discussion when viewed along with FIGS. 4–6. Specific reference also should be made to FIGS. 1–3 and the foregoing discussion for further details of elements or features not specifically described hereinafter. Referring now to FIG. 4, prior to refueling the boat, the boat owner, user, boat handler, or the party refueling the boat (hereinafter "user"), takes the spill containment device 100 according to the present invention and prepares it for attachment to the surface of boat hull 10. Specifically, the release paper 122 is removed from or peeled off the adhesive portion 120 of the plate member and the flexible bag is manipulated so as to be in a condition for receiving fluid therein. As indicated above, the spill containment device 100 might be arranged so as to look like that shown in FIG. 3 for storage so there might be a need to manipulate the bag out of this folded condition. In addition, the tab portion 112 is manipulated so that it is appropriately bent out of the plane of the main portion 111 of the plate member 110 for later use.

Thereafter, the user positions the spill containment device so that the plate member aperture 114 including the adhesive portion is facing the hull 10 and also facing the vent fitting/fixture 20. The spill containment device also is positioned such that that part of the plate member main portion 111 without the adhesive is orientated so as to be at and about the top. The user then advances the spill containment device 100 towards the hull in direction 150 so that when the plate member 110 contacts the hull 10, the vent fitting 20 is localized within the plate member aperture 114. After contacting the hull, the user works on the plate member 110 in an appropriate fashion so that the adhesive portions contact and adhesively engage the opposing surfaces of the hull. Such as that shown in FIGS. 5 and 6. In this position, the flexible bag 130 also can relax and rest against the outside surface of the hull 10 below the vent fitting or fixture 20.

After so positioning and securing the spill containment device 100 the user can begin to re-fill the fuel tank 40. For example, the user removes the fuel cap (not shown) and inserts the nozzle of the fuel line into the fill line to the fuel tank 40. Thereafter, any fuel passing up through the vent line 22 and thence out through the through hull vents fitting/fixture 20 passes directly into and is collected in the flexible bag 130 (i.e., the interior volume 132 of the flexible bag).

After fueling is completed, and according to one embodiment of the present invention, the user detaches the spill containment device 100 from the boat hull 10. For example, the user inserts a conventional boat hook in the tab portion aperture 116 and secures it therein. The user then manipulates the conventional boat hook so as to detach the spill containment device from the hull 10.

After detaching the spill containment device 100, the user properly disposes of any collected fuel and also disposes of the spent spill containment device. As to disposal of the fuel, the user pours the collected fuel from the spill containment device 100, more particularly the flexible bag 130 thereof, into another fuel tank, storage tank or equivalent structure for the disposal or continued use of the collected fuel. As noted above, the depressed region 124 of the plate member is used for controllably pouring the collected fuel from the flexible bag 130. As also noted above, in an alternative embodiment, the user further manipulates the depressed region 124 so as to form the depressed region into a more ideal shape for pouring the collected fluid into for example a storage container.

After emptying the flexible bag 130, the user disposes of the spent spill containment device 100 using any of a number of techniques known to those skilled in the art and otherwise in accordance with applicable rules and regulations. For example, spent spill containment devices 100 are disposed and collected in another storage container for later off-site disposal. It is within the scope of the present invention, however, for a user to re-use a spill containment device 100 dependent upon the condition of the device following the prior use. For example, the prior use may not have involved a spillage.

According to another embodiment, after re-fueling is completed, the user starts the engine(s) and runs it for a short period of time, for example 5 minutes to collect any possible additional spillages. Thereafter, the user detaches and disposes of the spill containment device as herein described. The user also can dispose of the fuel or gasoline as described above. Alternatively, the user could pour the collected fuel or gasoline into the fill line to the tank 40 using a similar technique. The running of the engines should have consumed at least an amount of fuel equal to the spillage collected in the time the engines were operated.

Although a preferred embodiment of the invention has been described using specific terms, such description is for illustrative purposes only, and it is to be understood that changes and variations may be made without departing from the spirit or scope of the following claims.

What is claimed is:

1. A fuel spill containment device that collects fuel being spilled from a vent of a fuel tank, the fuel spill containment device comprising:

a first member having a through aperture;

a flexible container being attached to the first member so that an interior volume of the flexible container is in fluid communication with the first member through aperture;

wherein the first member through aperture is configured and arranged so as to be larger than a structure of the vent as it passes through a surface of a tank support structure;

an adhesive layer being applied to a portion of a surface of the first member being at an angle to an axis of the through aperture, the portion being set so the first member is removably adhesively secured to the tank support structure surface; and wherein the adhesive layer is applied to the first member surface so that it extends one of about approximately ½ of the circumference of the first member or about approximately ¾ of the circumference of the first member.

2. The fuel spill containment device of claim 1, wherein the portion comprises about 50% of the first member surface.

3. The fuel containment device of claim 1, wherein the first member includes a tab portion that extends outwardly from a main portion of the first member, the main portion including the through aperture, where the tab portion includes a through aperture.

4. The fuel containment device of claim 3, wherein the adhesive layer is not applied to the first member main portion in the area of the tab portion.

5. A fuel spill containment device that collects fuel being spilled from a vent of a fuel tank, the fuel spill containment device comprising:

a first member having a through aperture;

a flexible container being attached to the first member so that an interior volume of the flexible container is in fluid communication with the first member through aperture;

wherein the first member through aperture is configured and arranged so as to be larger than a structure of the vent as it passes through a surface of a tank support structure;

an adhesive layer being applied to a portion of a surface of the first member being at an angle to an axis of the through aperture, the portion being set so the first member is removably adhesively secured to the tank support structure surface; and wherein a region of the first member in which the adhesive layer is not applied is configured and arranged so as to form a depression in the first member, the depression being useable as one of a nozzle or a vent for the interior volume when the first member is removably adhesively secured to the tank support structure surface.

6. A fuel spill containment device that collects fuel being spilled from a vent of a fuel tank of a motorized water vessel, the fuel spill containment device comprising:

a first member having a through aperture;

a flexible container being attached to the first member so that an interior volume of the flexible container is in fluid communication with the first member through aperture;

wherein the first member through aperture is configured and arranged so as to be larger than a structure of the vent as it passes through a hull surface of the motorized water vessel;

an adhesive layer being applied to a portion of a surface of the first member being at an angle to an axis of the through aperture, the portion being set so the first member is removably secured to the hull surface; and wherein the adhesive layer is applied to the first member surface so that it extends one of about approximately ½ of the circumference of the first member or about approximately ¾ of the circumference of the first member.

7. The fuel spill containment device of claim 6, wherein the portion comprises about 50% of the first member surface.

8. The fuel spill containment device of claim 6, wherein the adhesive layer is applied to at least that part of the first member surface that is located below the vent structure when the first member is releasably, adhesively secured to the hull surface.

9. The fuel containment device of claim 6, wherein the first member includes a tab portion that extends outwardly from a main portion of the first member, the main portion including the through aperture, where the tab portion includes a through aperture.

10. A fuel spill containment device that collects fuel being spilled from a vent of a fuel tank of a motorized water vessel, the fuel spill containment device comprising:

a first member having a through aperture;

a flexible container being attached to the first member so that an interior volume of the flexible container is in fluid communication with the first member through aperture;

wherein the first member through aperture is configured and arranged so as to be larger than a structure of the vent as it passes through a hull surface of the motorized water vessel;

an adhesive layer being applied to a portion of a surface of the first member being at an angle to an axis of the through aperture, the portion being set so the first member is removably secured to the hull surface; and wherein a region of the first member in which the adhesive layer is not applied is configured and arranged so as to form a depression in the first member, the depression being useable as one of a nozzle or a vent for the interior volume when the first member is removably adhesively secured to the tank support structure surface.

11. A fuel spill containment device that collects fuel being spilled from a vent of a fuel tank of a motorized water vessel, the fuel spill containment device comprising:

a first member having a through aperture;

a flexible container being attached to the first member so that an interior volume of the flexible bag is in fluid communication with the first member through aperture;

wherein the first member through aperture is configured and arranged so as to be larger than a structure of the vent as it passes through a hull surface of the motorized water vessel;

an adhesive layer being applied to a portion of a surface of the first member being at an angle to an axis of the through aperture, the portion being set so the first member is removably secured to the hull surface;

wherein the first member includes a tab portion that extends outwardly from a main portion of the first member, the main portion including the through aperture, where the tab portion includes a through aperture;

wherein the adhesive layer is applied to the first member surface so that it extends about approximately ½ or more of the circumference of the first member; and wherein a region of the first member in which the adhesive layer is not applied is configured and arranged so as to form a depression in the first member, the depression being useable as one of a nozzle or a vent for the interior volume when the first member is removably adhesively secured to the hull surface.

12. A method for containing fuel spilling from a vent of the fuel tank of a motorized water vessel, comprising the steps of:

providing a spill containment device including:

a first member having a through aperture, a flexible container being attached to the first member so that an interior volume of the flexible container is in fluid communication with the first member through aperture, and wherein the first member through aperture is configured and arranged so as to be larger than a structure of the vent as it passes through a hull surface of the motorized water vessel;

positioning the first member so that the vent structure is disposed within the first member through aperture, whereby the vent structure is in fluid communication with an interior volume of the flexible container; and releasably, adhesively securing a portion of the first member to the hull surface in proximity to the vent structure, wherein said releasable, adhesively securing includes releasable, adhesively securing a portion of the first member one of about ½ of the circumference of the first member or about ¾ of the circumference of the first member.

13. A method for containing fuel spilling from a vent of the fuel tank of a motorized water vessel, comprising the steps of:

providing a spill containment device including:

a first member having a through aperture, a flexible container being attached to the first member so that an interior volume of the flexible container is in fluid communication with the first member through aperture, and wherein the first member through aperture is configured and arranged so as to be larger than a structure of the vent as it passes through a hull surface of the motorized water vessel;

positioning the first member so that the vent structure is disposed within the first member through aperture, whereby the vent structure is in fluid communication with an interior volume of the flexible container;

releasably, adhesively securing a portion of the first member to the hull surface in proximity to the vent structure; and wherein a region of the first member in which the adhesive layer is not applied is configured and arranged so as to form a depression in the first member, and wherein said method further includes venting the interior volume via the depression when collecting fuel within the interior volume.

14. The spill containment method of claim 13, wherein at least a part of the portion being adhesively secured is located below the vent structure.

15. The spill containment method of claim 13, further comprising the step of detaching the first member from the hull surface.

16. The spill containment method of claim 15, wherein said positioning and said releasably adhesively securing is accomplished before refueling of the fuel tank and said detaching is accomplished after the refueling.

17. The spill containment method of claim 12, wherein the first member includes a tab portion having a through aperture extending from a main potion of the first member, the main portion including the first member through aperture, and wherein said method further comprises the steps of:

inserting an end portion of a boat hook into the tab portion through aperture; and manipulating the boat hook so as to detach the first member from the hull surface.

* * * * *